US006887519B1

(12) United States Patent
Pillhöffer et al.

(10) Patent No.: US 6,887,519 B1
(45) Date of Patent: May 3, 2005

(54) METHOD FOR COATING HOLLOW BODIES

(75) Inventors: Horst Pillhöffer, Röhrmoss (DE); Andreas Fritsch, Dachau (DE); Thomas Dautl, Markt Indersdorf (DE); Guido Schesny, München (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 09/857,763

(22) PCT Filed: Dec. 9, 1999

(86) PCT No.: PCT/DE99/03942

§ 371 (c)(1),
(2), (4) Date: Oct. 9, 2001

(87) PCT Pub. No.: WO00/34547

PCT Pub. Date: Jun. 15, 2000

(30) Foreign Application Priority Data

Dec. 10, 1998 (DE) ..... 198 56 901

(51) Int. Cl.[7] ..... C23C 16/08
(52) U.S. Cl. ..... 427/237; 427/252; 427/253
(58) Field of Search ..... 427/237, 252, 427/253

(56) References Cited

U.S. PATENT DOCUMENTS

| | | | | |
|---|---|---|---|---|
| 3,667,985 A | | 6/1972 | Levine et al. | |
| 3,958,047 A | | 5/1976 | Baldi | |
| 4,148,275 A | | 4/1979 | Benden et al. | |
| 4,156,042 A | * | 5/1979 | Hayman et al. | 427/253 |
| 4,208,453 A | | 6/1980 | Baldi | |
| 5,208,071 A | | 5/1993 | Davis et al. | |
| 5,215,785 A | * | 6/1993 | Strasser et al. | 427/230 |
| 5,989,733 A | * | 11/1999 | Warnes et al. | 428/652 |

FOREIGN PATENT DOCUMENTS

| | | |
|---|---|---|
| DE | 30 33 074 | 4/1981 |
| EP | 0 837 153 | 4/1998 |
| GB | 1 586 501 | 3/1981 |
| GB | 2 109 822 | 6/1983 |
| JP | 59-177360 | 10/1984 |

* cited by examiner

*Primary Examiner*—Timothy Meeks
(74) *Attorney, Agent, or Firm*—Kenyon & Kenyon

(57) ABSTRACT

A process for coating hollow bodies, in which a powder mixture including a metal donor powder, an inert filler powder and an activator powder including a metal halide is provided, the powder mixture is brought into contact with an inner surface, which is to be coated, of the hollow body and is heated, in which process, in order to increase the internal layer thicknesses, the inert filler powder is provided with a mean particle size which is approximately the same as the mean particle size of the metal donor powder.

10 Claims, No Drawings

METHOD FOR COATING HOLLOW BODIES

FIELD OF THE INVENTION

The present invention relates to a process for coating hollow bodies, in which a powder mixture comprising a metal donor powder, an inert filler powder and an activator powder is provided, the powder mixture is brought into contact with an inner surface, which is to be coated, of the body, e.g., including an Ni-, Co- or Fe-base alloy, and is heated.

BACKGROUND INFORMATION

Conventional processes for the diffusion coating of components made from heat-resistant alloys, such as Ni-, Co- or Fe-base alloys, include so-called powder pack processes. A process of this type is described, for example in U.S. Pat. No. 3,667,985, in which the component surfaces to be coated are 15 brought into contact with a donor powder including titanium and aluminum, to which an inert filler material and a halide activator are admixed, and is heated. U.S. Pat. No. 3,958,047 describes a powder pack process in which the metallic component is brought into contact with a donor powder which contains aluminum and chromium and is diffusion-coated by heating.

These processes are particularly suitable for coating the outer surfaces of metallic components, producing layer thicknesses of between 50 and 100 μm. However, these processes have inherent drawbacks when coating internal surfaces, and consequently the internal layer thicknesses which are achievable with relatively complicated geometrical forms with narrow gaps, tight angles or undercuts are limited and inadequate, generally being below 30 μm. A problem in this respect is that the donor powders have only a low ability to flow and therefore do not sufficiently fill the cavities. Moreover, after the coating, the donor powder can only be removed from the cavities with difficulty, and it is not possible to avoid leaving residues, and also the donor powder sinters to the surfaces.

The abovementioned drawbacks of the powder pack processes can in part be eliminated using so-called gas diffusion coating processes. One process of this type is described in U.S. Pat. No. 4,148,275, in which a powder mixture which contains, for example, aluminum is arranged in a first chamber and the metallic components to be coated are arranged in a second chamber of a vessel. The coating gas is generated by heating the powder and, using a carrier gas, is deposited on the outer and inner surfaces of the components to be coated. However, these gas diffusion coating processes have the drawback that the devices for carrying out the process, such as, for example, for the forced guidance of the coating gases, are complex and expensive compared to those used for the powder pack processes. Furthermore, the internal layer thicknesses which can be achieved are limited, since the coating gas or the donor metal gas is depleted on its route through the cavities of the component and a layer thickness gradient is produced along the length of the cavity. Since process conditions mean that the layer thickness of the outer coating is greater than that of the inner coating, the service life of the component is limited on account of the thinner internal coating.

U.S. Pat. No. 4,208,453 describes a process for the diffusion coating of the inner and outer surfaces of components, such as gas turbine blades, in which a powder mixture comprises 10% of chromium donor powder with a particle size of from 10 to 20 μm and 90% of alumina granules with a particle size of from 100 to 300 μm. In addition, a metal halide is added as activator. This process does not deal with measures for increasing the layer thickness in cavities of complicated geometry.

German Published Patent Application No. 30 33 074 describes a process for the diffusion coating of the inner surface of cavities, in which a metallic workpiece can be coated with an aluminizing diffusion powder mixture comprising 15% of aluminum powder with a particle size of 40 μm and 85% of alumina powder with a particle size of approximately 200 to 300 μm, as well as an $NH_4Cl$ powder.

U.S. Pat. No. 5,208,071 describes a process for aluminizing a ferritic component with an alumina slurry, followed by heat treatment, the slurry including at least 10% by weight of chromium, at least 10% by weight of inert filler material, at least 12% by weight of water, a binder and a halogen activator, and finally the coated ferritic component is heat-treated. The process technology involved means that the use of a slurry differs significantly from a powder pack coating process.

British Published Patent Application No. 2 109 822 describes a metal diffusion process with which diffusion coatings can be produced more quickly than in the powder pack process, the coating powder being in loose form and being kept in contact with the component to be coated, in particular including with its internal surface, by mechanical means during the heating. The composition of the coating powder may comprise 10 to 60% of chromium powder, 0.1 to 20% of chromium halide and alumina.

It is an object of the present invention to provide an improved powder pack process so that the layer thicknesses of the internal coating are sufficiently great even in the case of cavities with relatively complex geometries.

SUMMARY

According to one example embodiment of the present invention, the inert filler powder has a mean particle size which is approximately the same as the mean particle size of the metal donor powder.

One advantage of the method according to the present invention is that, when the particle sizes are selected in this way, it is possible to increase the specific density without agglomeration of the powder mixture, for example, due to an excessively high metal donor powder content. It is also ensured that there is no premature depletion of the donor metal. A powder mixture of this type has sufficient flow properties and, in tight corners, gains access to internal cavities which are to be coated. It is possible to coat hollow bodies, such as guide vanes and rotor blades of gas turbines made from heat-resistant Ni-, Co- or Fe-base alloys. Even in tight corners or recessed regions of the cavities, the layer thicknesses of the internal coating are in the range of 50 to 110 μm, therefore ensuring that the internal coating functions as an oxidation-resistant and corrosion-resistant layer.

The metal donor powder and the inert filler powder may have a mean particle size of greater than 40 μm, so that it is possible to achieve sufficient permeation of the coating gas through the bed of the powder mixture. The powder mixture may include a metal donor powder content of 10 to 25% by weight, in order to prevent agglomeration of the powder mixture and to ensure sufficient permeation through the bed.

Furthermore, an alloy having a donor metal content of 20 to 80% by weight may be provided as the metal donor powder, so that a sufficiently large layer thickness is ensured due to the high donor metal content.

A mixture of an alloy having a donor metal content of 40 to 70% by weight and an alloy having a donor metal content of 30 to 50% by weight may be provided as the metal donor powder, so that the depletion of the metal donor in the two alloys takes place in steps, i.e., with a time delay.

The metal donor powder and the inert filler powder may be provided with a mean or average particle size of 150 $\mu$m. A powder mixture of this type has sufficient flow properties and fills the cavities having the internal surfaces to be coated due to an advantageous specific bulk density. In addition, there is sufficient permeation of the coating gas through the bed of the powder mixture.

DETAILED DESCRIPTION

The present invention is explained in more detail below with reference to specific examples.

In a first example, the hollow body is a hollow turbine guide vane of a gas turbine, which is provided with an oxidation-resistant and corrosion-resistant layer.

The cavity has a length of approximately 160 mm. Its inner surfaces are spaced apart at between 2 and 6 mm and converge at two opposite end sections. To coat the inner surfaces of the guide vanes, a powder mixture including approximately 20% by weight of metal donor powder and approximately 80% by weight of inert filler powder is provided. AlCr is selected as the metal donor powder, and $Al_2O_3$ is selected as the inert filler powder. The melting point of AlCr is at least approximately 100° C. higher than the coating temperature of approximately 800° C. –1200° C., so that there is no diffusion bonding of the metal particles to one another or agglomeration.

An activator powder forms approximately 3% by weight, the powder selected being $AlF_3$, i.e., a halide compound. Another example of a suitable activator powder is $CrCl_3$. A compound of this type should have a low vapor pressure at the coating temperature, so that it is retained throughout the entire coating process. Moreover, a halide compound of the donor metal, in this case aluminum, is used, in order to avoid agglomeration as a result of a chemical reaction of the halogen with the donor metal.

The aluminum content, i.e., the metal donor content, in the metal donor powder is 50% by weight.

The powder mixture which has been prepared in this manner is introduced into the cavity of the guide vanes for the purpose of coating the internal surfaces. The subsequent coating is performed at 1080° C. with a holding time of 6 h, while the external coating, i.e., the coating of the outer surfaces of the guide vane, may be performed simultaneously in a single-stage process using a conventional powder pack process or alternatively by a gas diffusion coating process.

In the internal coating which is deposited in this manner, the Al content in the layer is between 30 and 35% by weight.

In a second example, an inert filler powder ($Al_2O_3$) having a mean particle size of approximately 100 $\mu$m is again selected, forming approximately 80% by weight of the powder mixture. As activator powder, $AlF_3$ forming approximately 3% by weight of a powder mixture is selected and admixed.

Unlike in the first example, the metal donor powder, which forms approximately 20% by weight of the powder mixture, includes two fractions. The first fraction is an alloy including AlCr, in which the aluminum content is 50% by weight. In the second fraction, the donor metal content, i.e., the aluminum content, is lower, being 30% by weight. This measure may be used to optimize the coating process so that the fraction with the lower Al content is depleted, but the coating process is continued by the fraction with the higher Al content. In this manner, it is possible to increase the ductility of the layers on the inner surfaces of the guide vane.

The Al content in the inner layers is 24 to 28% by weight. The inner layer thicknesses are between 65 and 105 $\mu$m and are therefore significantly above the layer thicknesses which can be achieved with the conventional (powder pack) processes.

In a third example, the hollow body is a hollow turbine guide vane of a gas turbine, which is provided with an oxidation-resistant and corrosion-resistant layer by a powder pack coating process. The elongate cavity is approximately 180 mm long. The inner surfaces are spaced apart at between 2 and 6 mm and converge at two opposite, longitudinal-side end sections. To coat the inner surface of the guide vane, a powder mixture including approximately 15% by weight of metal donor powder and just below 85% by weight of inert filler powder is provided. Depending on the particular application, the metal donor powder content may be in the range of 10 to 25% by weight. The metal donor powder is AlCr, and the inert filler powder is $Al_2O_3$. The activator powder used is a halogen compound, such as $AlF_3$, forming approximately 3% by weight. The activator powder is therefore a halide compound of the donor metal Al.

The mean particle size of the inert filler powder is approximately equal to the mean particle size of the metal donor powder, being 150 $\mu$m. The proportion of the donor metal Al in the metal donor powder, which is an alloy, is 50% by weight. The specific density of a powder pack mixture is high not because of a high metal donor powder content, but rather because of the selected particle size distribution. With this bed of the powder pack mixture, there is sufficient permeation by the coating gases emanating from the halide compound.

To coat the inner surface of the turbine guide vane, the powder mixture which has been prepared in this manner is introduced into its cavity. At the selected particle size distribution of the inert filler powder and of the metal donor powder, the bed has sufficient flow properties and gains access even to the tight corners of the cavity. The subsequent coating is performed at 1080° C. for a holding time of 6 h. It may be performed at the same time as the external coating, i.e., the coating of the outer surface of the turbine guide vane, which may be performed using a conventional powder pack process or also using a gas diffusion coating process. Generally, the coating is performed on a plurality of turbine guide vanes simultaneously.

The Al content in the internal coating which has been deposited in this manner is between 30 and 35% by weight and consequently in a highly advantageous range, i.e., there is, for example, no embrittlement of the layer.

Even in tight corners or recessed regions of the cavities, the layer thicknesses are in the range of 60 to 110 $\mu$m, thus ensuring that the internal coating function has protection against oxidation and corrosion.

What is claimed is:

1. A method for coating a hollow body, comprising the steps of:

contacting a powder mixture with an inner surface of the hollow body to be coated, the powder mixture including a metal donor powder, an inert filler powder and an activator powder, the activator powder including a metal halide; and heating the powder mixture;

wherein a mean particle size of the inert filler powder is approximately equal to a mean particle size of the metal donor powder;

wherein the mean particle size of the metal donor powder and the mean particle size of the inert filler powder are greater than 40 $\mu$m;

wherein a metal donor powder content is 10% to 25% by weight of the powder mixture;

wherein the metal donor powder includes a mixture of a first alloy having a donor metal content of 40% to 70% by weight and a second alloy having a donor metal content of 30% to 50% by weight; and wherein depletion of the metal donor in the first and second alloys takes place in steps with a time delay.

2. The method according to claim 1, wherein the powder mixture includes an activator powder content of 2% to 5% by weight.

3. The method according to claim 1, wherein the metal halide of the activator powder includes a metal halide of a donor metal.

4. The method according to claim 1, wherein the donor metal powder includes AlCr.

5. The method according to claim 1, wherein the mean particle size of the metal donor powder and the mean particle size of the inert filler powder are approximately 150 $\mu$m.

6. A method for coating a hollow body, comprising the steps of:

contacting a powder mixture with an inner surface of the hollow body to be coated, the powder mixture including a metal donor powder, an inert filler powder and an activator powder, the activator powder including a metal halide; and heating the powder mixture;

wherein a mean particle size of the inert filler powder is equal to a mean particle size of the metal donor powder;

wherein the mean particle size of the metal donor powder and the mean particle size of the inert filler powder are greater than 40 $\mu$m;

wherein a metal donor powder content is 10% to 25% by weight of the powder mixture;

wherein the metal donor powder includes a mixture of a first alloy having a donor metal content of 40% to 70% by weight and a second alloy having a donor metal content of 30% to 50% by weight; and wherein a coating formed on the hollow body has a higher ductility on inner surfaces of the hollow body.

7. The method according to claim 6, wherein the powder mixture includes an activator powder content of 2% to 5% by weight.

8. The method according to claim 6, wherein the metal halide of the activator powder includes a metal halide of a donor metal.

9. The method according to claim 6, wherein the donor metal powder includes AlCr.

10. The method according to claim 6, wherein the mean particle size of the metal donor powder and the mean particle size of the inert filler powder are approximately 150 $\mu$m.

* * * * *

UNITED STATES PATENT AND TRADEMARK OFFICE

CERTIFICATE OF CORRECTION

PATENT NO. : 6,887,519 B1
DATED : May 3, 2005
INVENTOR(S) : Pillhöffer et al.

It is certified that error appears in the above-identified patent and that said Letters Patent is hereby corrected as shown below:

Column 1,
Line 19, change "coated are 15 brought into contact" to -- coated are brought into contact --.

Signed and Sealed this

Ninth Day of May, 2006

JON W. DUDAS
*Director of the United States Patent and Trademark Office*